US010267586B1

(12) United States Patent
Marfione

(10) Patent No.: US 10,267,586 B1
(45) Date of Patent: Apr. 23, 2019

(54) SUPPRESSOR FOR A FIREARM

(71) Applicant: Microtech Knives, Inc., Bradford, PA (US)

(72) Inventor: Anthony Marfione, Fletcher, NC (US)

(73) Assignee: Microtech Knives, Bradford, PA (US)

( * ) Notice: Subject to any disclaimer, the term of this patent is extended or adjusted under 35 U.S.C. 154(b) by 0 days.

(21) Appl. No.: 15/963,468

(22) Filed: Apr. 26, 2018

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/34; F41A 21/36; F41A 21/38
USPC ..... 89/14.2, 14.3, 14.4; 42/1.06; 181/223
See application file for complete search history.

(56) References Cited

U.S. PATENT DOCUMENTS 1,327,897 A * 1/1920 Baldwin ..... F41A 5/20 89/125
2,375,617 A * 5/1945 Bourne ..... F41A 21/30 181/223
3,272,074 A * 9/1966 Vinson ..... F41A 21/34 144/144.1
3,368,453 A * 2/1968 Shaw ..... F41A 21/36 89/14.3
4,576,083 A 3/1986 Seberger, Jr.
4,588,043 A 5/1986 Finn
4,920,854 A 5/1990 Scanlon
5,029,512 A 7/1991 Latka
5,559,302 A 9/1996 Latka
6,575,074 B1 6/2003 Gaddini
7,308,967 B1 * 12/2007 Hoel ..... F41A 21/30 181/223
7,931,118 B1 4/2011 Cronhelm
7,987,944 B1 * 8/2011 Brittingham ..... F41A 21/30 181/223
8,991,550 B2 * 3/2015 Coley ..... F41A 21/30 181/223
9,470,466 B2 10/2016 Washburn, III et al.
2010/0180759 A1 * 7/2010 Petersen ..... F41A 21/30 89/14.4
2012/0152649 A1 6/2012 Larue
2016/0018179 A1 * 1/2016 Morris ..... F41A 21/30 181/223

* cited by examiner

*Primary Examiner* — Bret Hayes
(74) *Attorney, Agent, or Firm* — Steve LeBlanc LLC.

(57) ABSTRACT

A suppressor for a firearm includes a casing that defines an axis, and a baffle is in the casing. The baffle has upstream and downstream surfaces and a frustoconical surface between the upstream and downstream surfaces. The baffle defines a fluid pathway through the upstream, downstream, and frustoconical surfaces along the axis. An annular chamber is located between the frustoconical surface and the casing. A first contoured wall extends upstream a first height from the upstream surface, and the first contoured wall defines a perimeter around a first damping well in the upstream surface. A second contoured wall extends upstream a second height from the upstream surface, and the second contoured wall defines a perimeter around a second damping well in the upstream surface. The first height of the first contoured wall is larger than the second height of the second contoured wall.

13 Claims, 9 Drawing Sheets

SUPPRESSOR FOR A FIREARM

FIELD OF THE INVENTION

The present invention generally involves a suppressor for a firearm.

BACKGROUND OF THE INVENTION

A conventional firearm operates by combusting gunpowder or other accelerant to generate combustion gases that propel a projectile through a barrel and out of the muzzle. The rapidly expanding combustion gases exit the muzzle to produce a characteristic loud bang commonly associated with gunfire.

A suppressor (also commonly referred to as a silencer) is a device attached to the muzzle of the firearm to dissipate energy of the combustion gases to reduce the noise signature of the firearm. The suppressor generally includes a number of baffles serially arranged or stacked inside a casing. A longitudinal pathway through the baffle stack allows the projectile to pass through the suppressor unobstructed, while the baffle stack redirects the combustion gases inside the casing to allow the combustion gases to expand, cool, and otherwise dissipate energy before exiting the suppressor. The combustion gases thus exit the suppressor with less energy, reducing the noise signature associated with the discharge of the firearm.

While numerous suppressor designs exist to reduce the noise signature of a firearm, the need exists for continued improvements that further reduce the noise signature of a firearm. In particular, improvements in the baffle design and orientation may enhance the expansion, cooling, and/or energy dissipation of the combustion gases passing through the suppressor, reducing the noise signature associated with the discharge of the firearm.

BRIEF DESCRIPTION OF THE INVENTION

Aspects and advantages of the invention are set forth below in the following description, or may be obvious from the description, or may be learned through practice of the invention.

One embodiment of the present invention is a suppressor for a firearm. The suppressor includes a casing that defines a longitudinal axis and a first baffle located in the casing. The first baffle has an upstream surface, a downstream surface, and a frustoconical surface between the upstream and downstream surfaces. The first baffle defines a fluid pathway through the upstream, downstream, and frustoconical surfaces along the longitudinal axis. An annular chamber is located between the frustoconical surface of the first baffle and the casing. A first contoured wall extends upstream a first height from the upstream surface of the first baffle, and the first contoured wall defines a perimeter around a first damping well in the upstream surface. A second contoured wall extends upstream a second height from the upstream surface of the first baffle, and the second contoured wall defines a perimeter around a second damping well in the upstream surface. The first height of the first contoured wall is larger than the second height of the second contoured wall.

An alternate embodiment of the present invention is a suppressor for a firearm that includes a casing that defines a longitudinal axis and a plurality of baffles located in the casing. Each baffle has an upstream surface, a downstream surface, and a frustoconical surface between the upstream and downstream surfaces. Each baffle defines a fluid pathway through the upstream, downstream, and frustoconical surfaces along the longitudinal axis. An annular chamber is located between the frustoconical surface of each baffle and the casing. A first contoured wall extends upstream a first height from the upstream surface of each baffle, and the first contoured wall defines a perimeter around a first damping well in the upstream surface. A second contoured wall extends upstream a second height from the upstream surface of each baffle, and the second contoured wall defines a perimeter around a second damping well in the upstream surface. The first height of the first contoured wall of each baffle is larger than the second height of the second contoured wall.

In yet another embodiment of the present invention, a suppressor for a firearm includes a casing that defines a longitudinal axis and a first baffle located in the casing. The baffle has an upstream surface, a downstream surface, and a frustoconical surface between the upstream and downstream surfaces. The first baffle defines a fluid pathway through the upstream, downstream, and frustoconical surfaces along the longitudinal axis. An annular chamber is located between the frustoconical surface of the first baffle and the casing. A fluid passage between the upstream surface and the frustoconical surface provides fluid communication to the annular chamber between the frustoconical surface of the first baffle and the casing. An arcuate recess in the upstream surface is radially opposed to the fluid passage between the upstream surface and the frustoconical surface.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
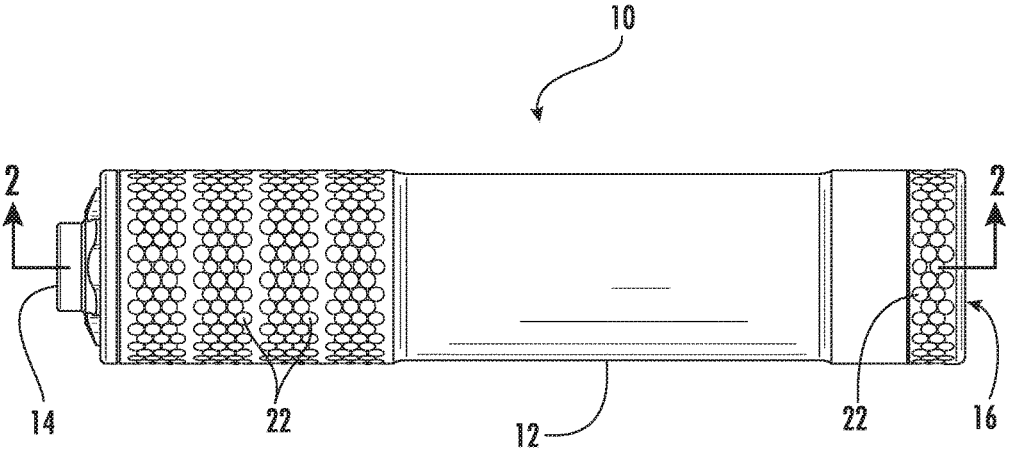
FIG. 1 is a side plan view of a suppressor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. As used herein, the terms "upstream" and "downstream" refer to the relative location of components in a fluid pathway. For example, component A is upstream of component B if a fluid flows from component A to component B. Conversely, component B is downstream of component A if component B receives a fluid flow from component A. As used herein, the term "axial" refers to a direction of flow through an object; the term "radial" refers to a direction extending away from the center of an object or normal to the "axial" direction, and the term "circumferential" refers to a direction extending around the circumference or perimeter of an object.

Figure 2:
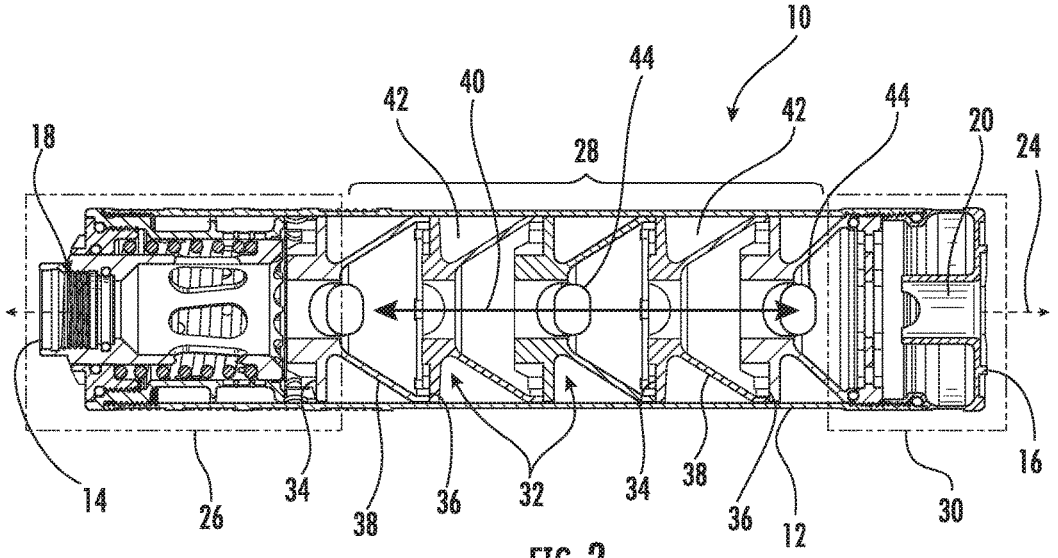
FIG. 2 is a side cross-section view of the suppressor shown in FIG. 1 taken along line 2-2.

Embodiments of the present invention provide a suppressor for a firearm with improved sound damping and/or thermal performance compared to existing suppressor designs. FIG. 1 provides a side plan view of a suppressor 10 according to one embodiment of the present invention, and FIG. 2 provides a side cross-section view of the suppressor 10 shown in FIG. 1 taken along line 2-2. As shown in FIGS. 1 and 2, the suppressor 10 generally includes a casing 12 that contains the internal components of the suppressor 10 and provides the structure for connecting the suppressor 10 to the firearm. For convention, a rear end 14 of the casing 12 refers to the end of the casing 12 that connects to the firearm, and a front end 16 of the casing 12 refers to the opposite end of the casing 12 from which a bullet or other projectile exits. The rear end 14 of the casing 12 generally includes threads 18 or other structure known in the art for attaching the suppressor 10 to the muzzle end of the firearm. The front end 16 of the casing 12 generally terminates in an opening 20 through which the bullet or other projectile from the firearm passes. The casing 12 may further include various textured surfaces 22 between the rear and front ends 14, 16 to facilitate handling and gripping the suppressor 10.

As shown in FIG. 2, the casing 12 generally defines a longitudinal axis 24 for the suppressor 10 and contains the internal components of the suppressor 10. The casing 12 and internal components of the suppressor 10 may be constructed from any material suitable for exposure to the pressures and temperatures normally associated with the discharge of a firearm. For example, in particular embodiments, the casing 12 and internal components of the suppressor 10 may be constructed from metal, fiberglass, carbon, polymers, or other composite materials known in the art. The casing 12 is typically cylindrical, although the particular geometry of the casing 12 is not a limitation of the present invention unless specifically recited in the claims.

In the particular embodiment shown in FIG. 2, the suppressor 10 generally includes a rear baffle stack support assembly 26, a baffle stack assembly 28, and a front baffle stack support assembly 30. The rear baffle stack support assembly 26 generally includes structure for connecting the suppressor 10 to the firearm, as well as structure for preconditioning the combustion gases upstream of the baffle stack assembly 28. The baffle stack assembly 28 generally includes a series of baffles 32 in a stacked relationship to further cool and reduce the energy of the combustion gases. For example, as shown in FIG. 2, the baffle stack assembly 28 may include five baffles 32 sequentially stacked together. The front baffle stack support assembly 30 generally holds the baffles 32 in place and provides expansion capability so additional baffles 32 may be added to the baffle stack assembly 28 if desired.

Figure 3:
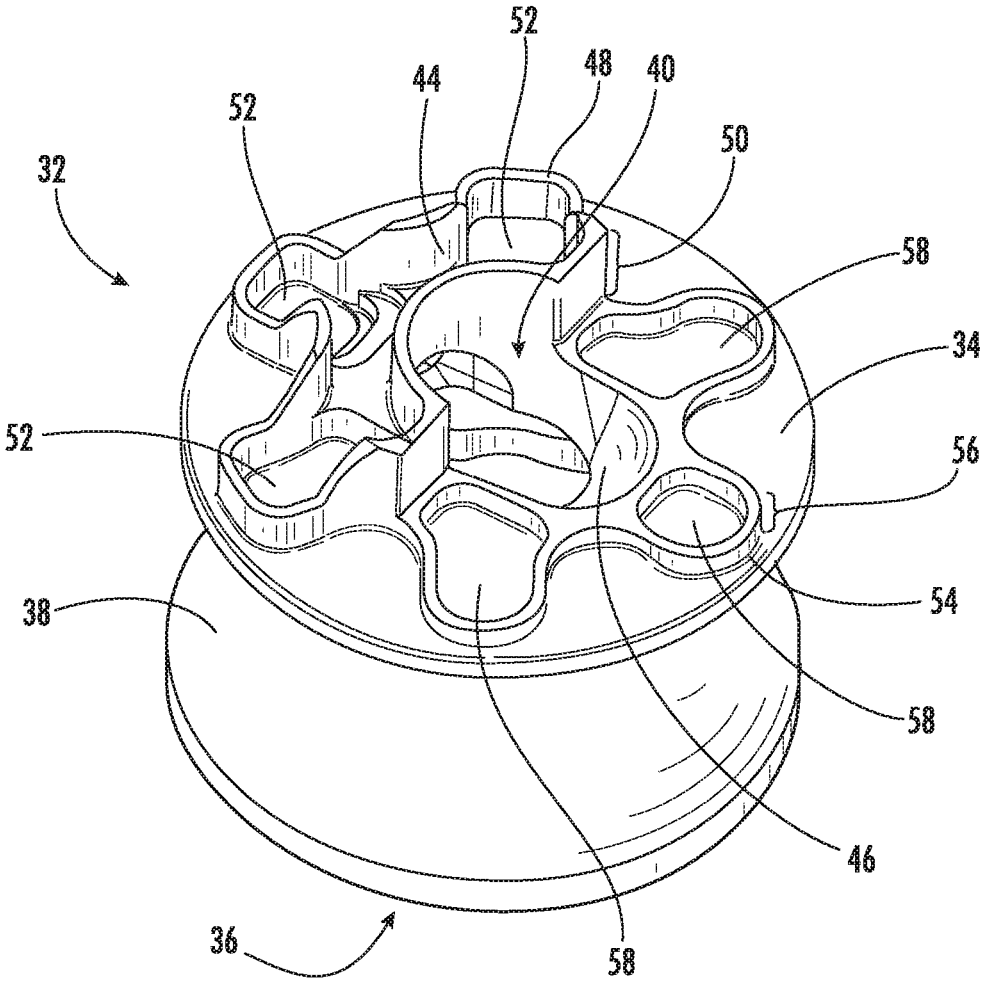
FIG. 3 is a rear perspective view of a baffle shown in FIG. 2 according to one embodiment of the present invention.
Figure 4:
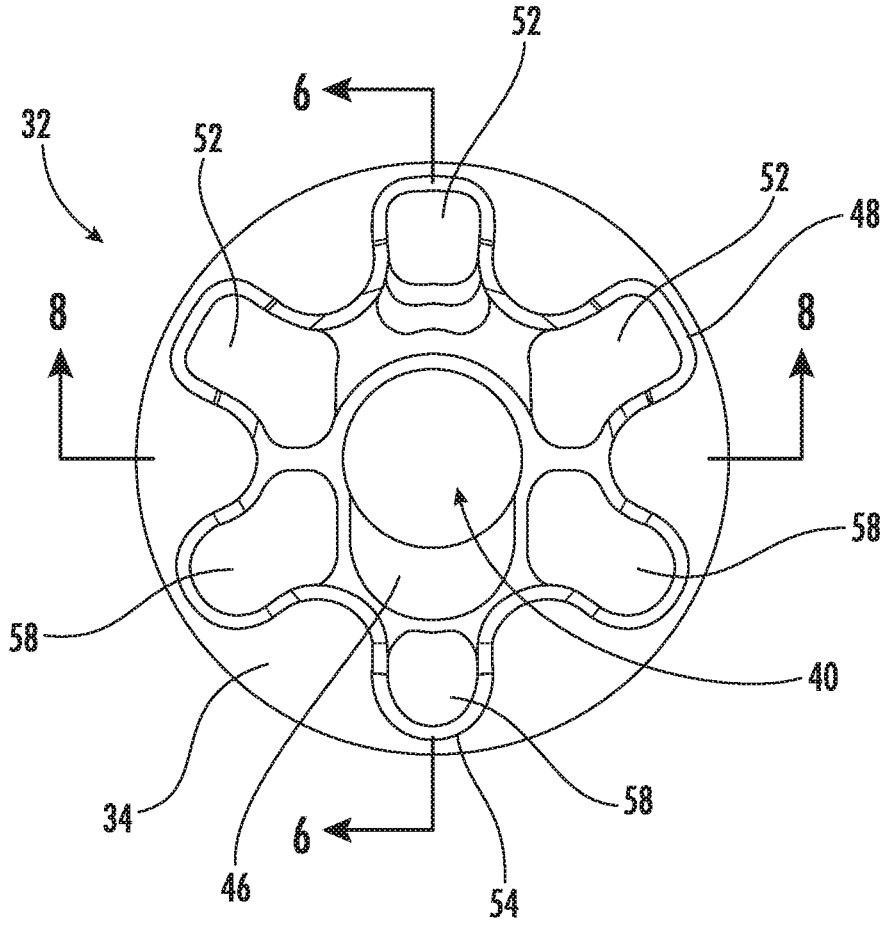
FIG. 4 is a rear plan view of the baffle shown in FIG. 3.
Figure 5:
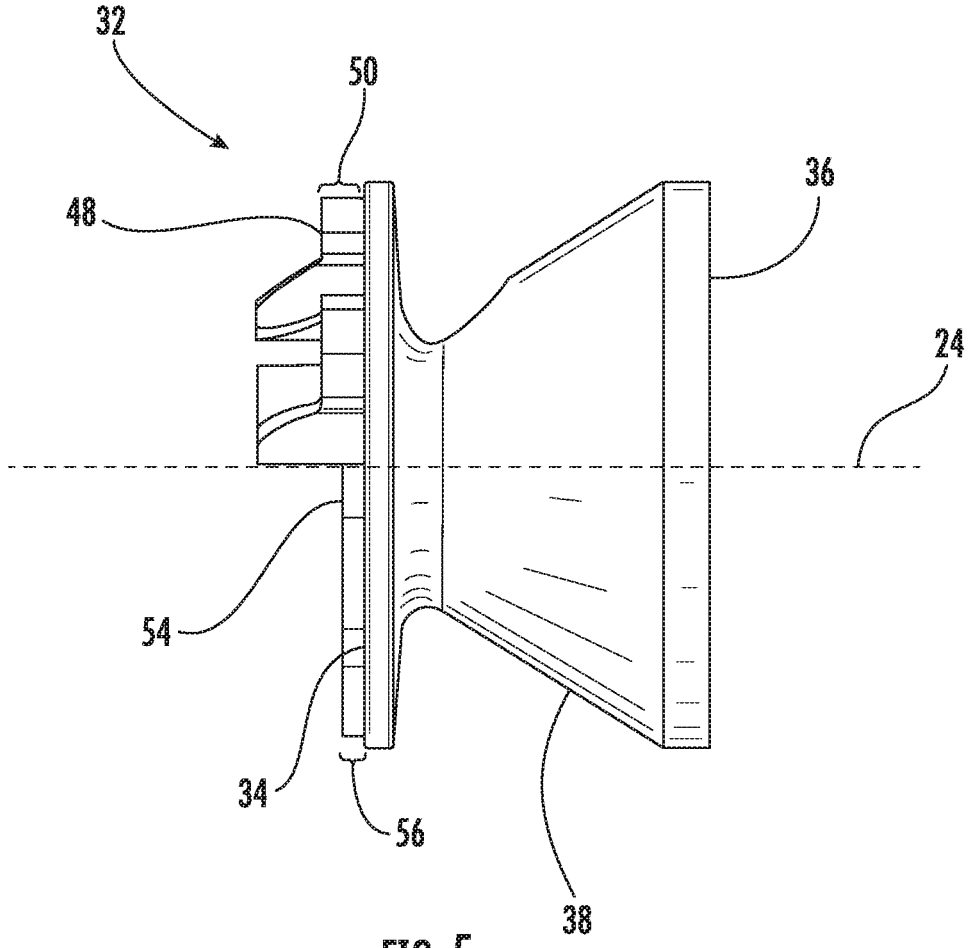
FIG. 5 is a side plan view of the baffle shown in FIG. 4 viewed from the right.
Figure 6:
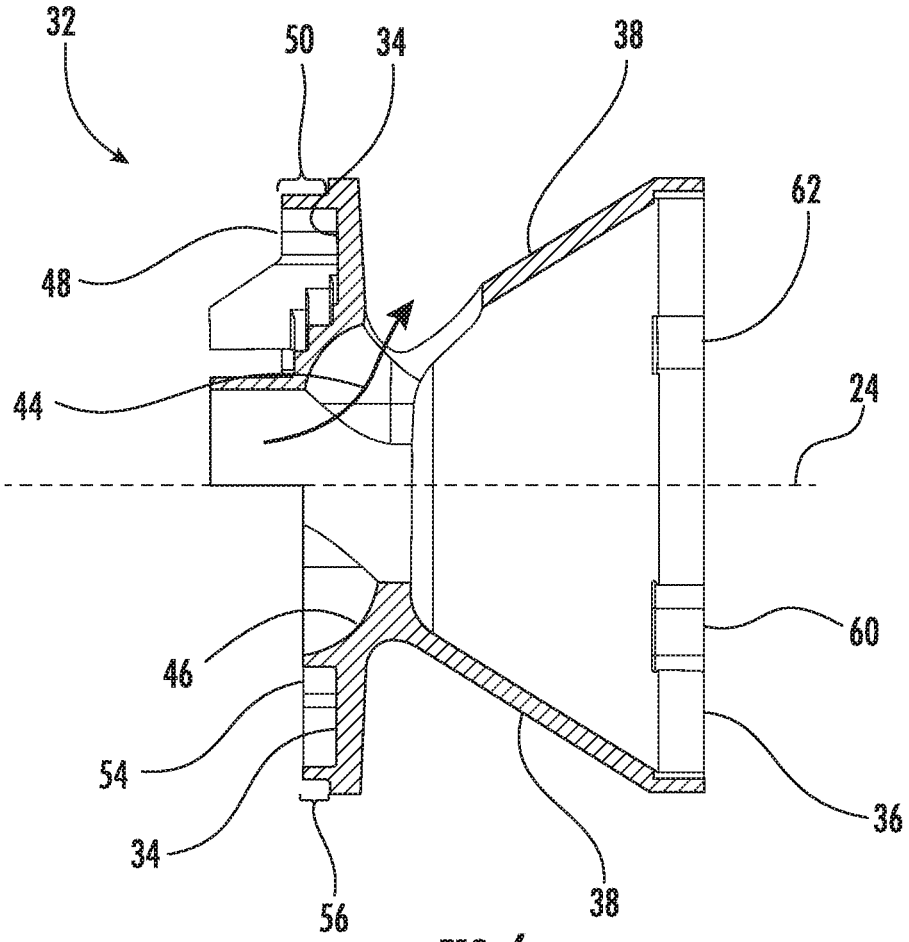
FIG. 6 is a side cross-section view of the baffle shown in FIG. 4 taken along line 6-6.
Figure 7:
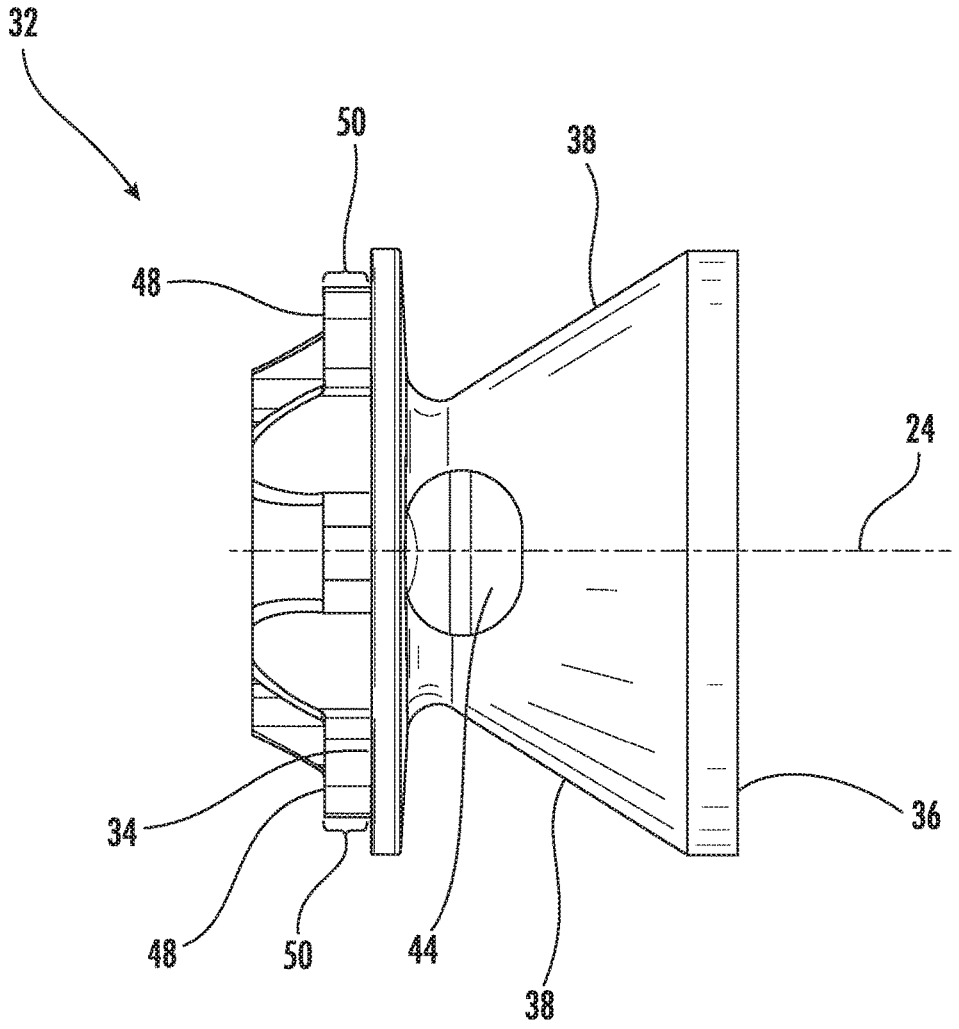
FIG. 7 is a side plan view of the baffle shown in FIG. 4 viewed from the top.
Figure 8:
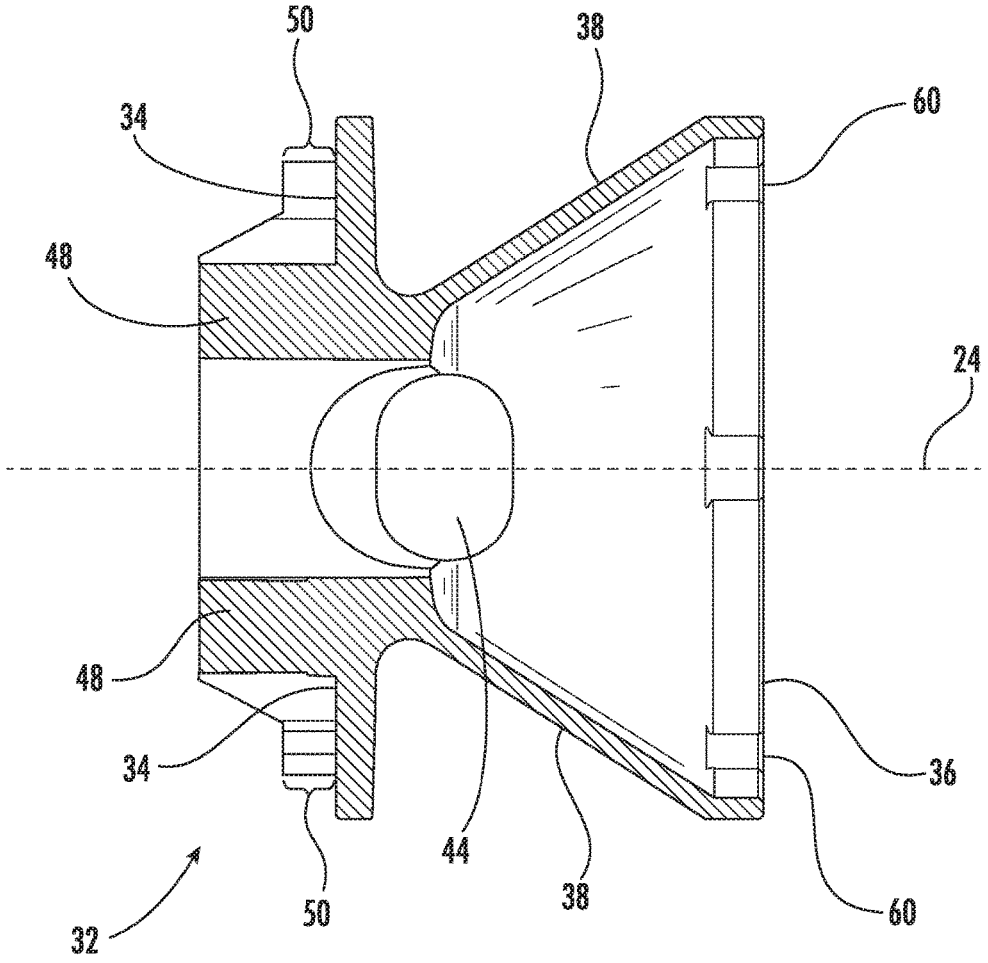
FIG. 8 is a side cross-section view of the baffle shown in FIG. 4 taken along line 8-8.

FIG. 3 provides a rear perspective view of an exemplary baffle 32 shown in FIG. 2 according to one embodiment of the present invention, and FIG. 4 provides a rear plan view of the baffle 32 shown in FIG. 3. FIG. 5 provides a side plan view of the baffle 32 shown in FIG. 4 viewed from the right, and FIG. 6 provides a side cross-section view of the baffle 32 shown in FIG. 4 taken along line 6-6. FIG. 7 provides a side plan view of the baffle 32 shown in FIG. 4 viewed from the top, and FIG. 8 provides a side cross-section view of the baffle 32 shown in FIG. 4 taken along line 8-8.

As shown in FIGS. 2-8, each baffle 32 generally includes an upstream surface 34, a downstream surface 36, and a frustoconical surface 38 between the upstream and downstream surfaces. Each baffle 32 further defines a fluid pathway 40 through the upstream, downstream, and frustoconical surfaces along the longitudinal axis 24. As shown most clearly in FIG. 2, the stacked arrangement of the baffles 32 inside the casing 12 produces an annular chamber 42 between the frustoconical surface 38 of each baffle 32 and the casing 12. The annular chambers 42 provide additional quenching volumes to reduce the temperature, pressure, velocity, and energy of the combustion gases passing through the suppressor 10.

As variously shown in FIGS. 2, 3, and 6-8, each baffle 32 includes a fluid passage 44 between the upstream surface 34 and the frustoconical surface 38. The fluid passage 44 provides fluid communication to the annular chamber 42 between the frustoconical surface 38 and the casing 12. In addition, as shown in FIGS. 3, 4, and 6, each baffle 32 may further include an arcuate recess 46 in the upstream surface 34 radially opposed to the fluid passage 44. The combination of the arcuate recess 46 disposed radially across from the fluid passage 44 allows each baffle 32 to divert a portion of the combustion gases flowing through the fluid pathway 40 into the annular chamber 42. The diverted combustion gases expand in the annular chamber 42 to reduce the temperature, pressure, velocity, and energy of the combustion gases before exiting the suppressor 10.

FIGS. 3-8 also illustrate the presence of contoured walls 48, 54 having different heights 50, 56 that extend axially upstream from the upstream surface 34 to define perimeters around damping wells 52, 58 in the upstream surface 34. Specifically, a first contoured wall 48 extends axially upstream a first height 50 from the upstream surface 34 of each baffle 32 to define a perimeter around one or more first damping wells 52 in the upstream surface 34. A second contoured wall 54 similarly extends axially upstream a second height 56 from the upstream surface 34 of each baffle 32 to define a perimeter around one or more second damping wells 58 in the upstream surface 34. As shown in FIGS. 3, 5, and 6, the first height 50 of the first contoured wall 48 is larger or taller than the second height 56 of the second contoured wall 54. In addition, as shown most clearly in FIGS. 3 and 4, the shapes of the damping wells 52, 58 formed by the first and second contoured walls 48, 54, respectively, may be different shapes. For example, as shown in FIGS. 3 and 4, the damping wells 52 formed by the first contoured wall 48 may have a squared perimeter, while the damping wells 58 formed by the second contoured wall 54 may have a rounded perimeter.

The contoured walls 48, 54 and resulting damping wells 52, 58 provide several advantages over existing designs to enhance the performance of the suppressor 10. For example, the additional surface area provided by the contoured walls 48, 54 increases cooling to the combustion gases flowing through the suppressor 10. The increased cooling in turn reduces the pressure and velocity of the combustion gases, providing a corresponding reduction in the energy of the combustion gases exiting the suppressor 10. In addition, the perimeters formed by the contoured walls 48, 54 create separate damping wells 52, 58 that further disrupt the flow of combustion gases through the suppressor 10, thereby further reducing the velocity of the combustion gases. Lastly, the different heights 50, 56 of the contoured walls 48, 54 produce a stepped face that reduces the weight of each baffle 32 and, combined with the fluid passage 44 and arcuate recess 46, creates a planar effect to enhance the diversion of combustion gases into the annular chamber 42.

Figure 9:
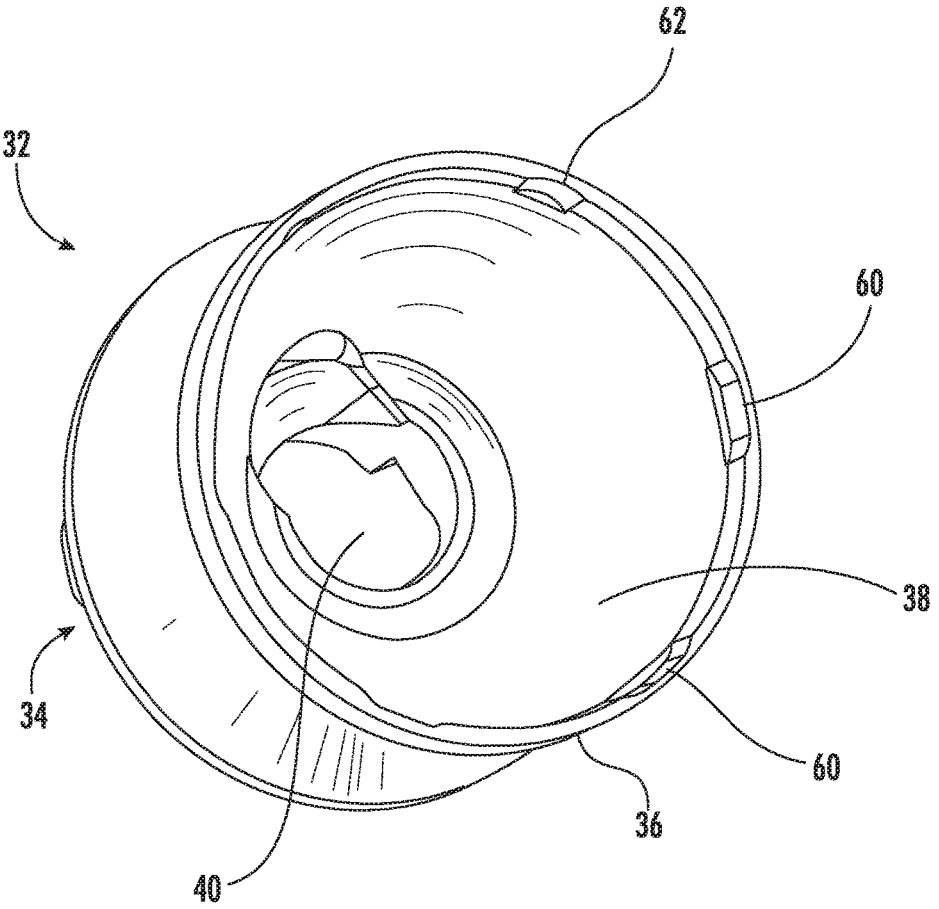
FIG. 9 is a front perspective view of the baffle shown in FIG. 3.
Figure 10:
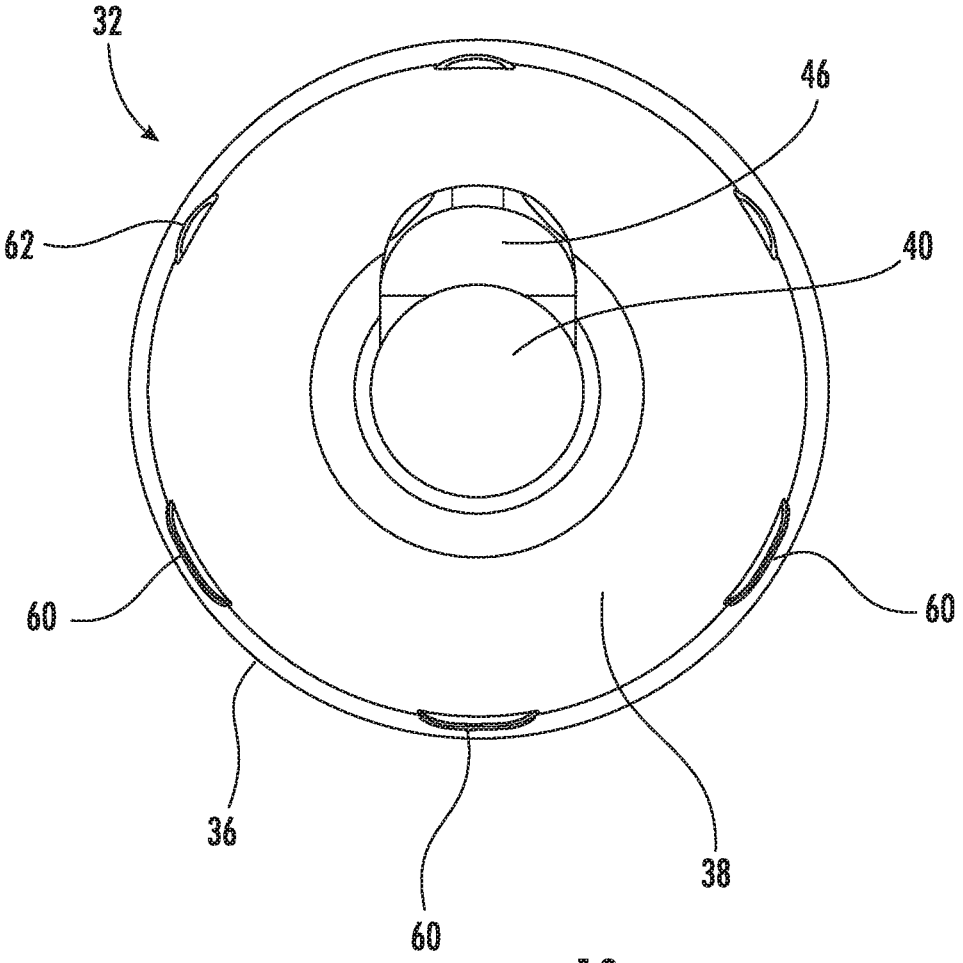
FIG. 10 is a front plan view of the baffle shown in FIG. 3.

FIG. 9 provides a front perspective view of the baffle 32 shown in FIG. 3, and FIG. 10 provides a front plan view of the baffle 32 shown in FIG. 3. As shown in FIGS. 6 and 8-10, the downstream surface 36 of each baffle 32 may further include one or more alignment grooves 60, 62. The alignment grooves 60, 62 correspond in shape with the outermost portion of the contoured walls 48, 54 of the immediately downstream baffle 32. For example, squared alignment grooves 60 correspond in shape with the first contoured wall 48 around the perimeter of the first damping wells 52, and rounded alignment grooves 62 correspond in shape with the second contoured wall 54 around the perimeter of the second damping wells 58.

The location of the alignment grooves 60, 62 around the downstream surface 36 of each baffle 32 allows adjacent baffles 32 to be indexed in a predetermined relationship with respect to one another. In particular embodiments, for example, the alignment grooves 60, 62 may be arranged around the downstream surface 36 of each baffle 32 so that the features in each baffle 32 are aligned with one another along the longitudinal axis 24. Alternately, as shown in the particular embodiment shown in FIGS. 2-10, the alignment grooves 60, 62 are arranged around the downstream surface 36 of each baffle 32 so that adjacent baffles 32 are indexed 180 degrees out of phase with one another along the longitudinal axis 24. In either event, the alignment grooves 60, 62 enable slight adjustments to the alignment of the adjacent baffles 32 to fine tune the suppressor 10 performance for different firearms.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A suppressor for a firearm, comprising:

a casing that defines a longitudinal axis;

a first baffle located in said casing, wherein said first baffle has an upstream surface, a downstream surface, and a frustoconical surface between said upstream and downstream surfaces, and said first baffle defines a fluid pathway through said upstream, downstream, and frustoconical surfaces along said longitudinal axis;

an annular chamber between said frustoconical surface of said first baffle and said casing;

a first contoured wall that extends upstream a first height from said upstream surface of said first baffle, wherein said first contoured wall defines a perimeter around a first damping well in said upstream surface;

a second contoured wall that extends upstream a second height from said upstream surface of said first baffle, wherein said second contoured wall defines a perimeter around a second damping well in said upstream surface; and wherein said first height of said first contoured wall is larger than said second height of said second contoured wall.

2. The suppressor as in claim 1, wherein said first contoured wall defines a perimeter around a plurality of first damping wells in said upstream surface.

3. The suppressor as in claim 1, wherein said second contoured wall defines a perimeter around a plurality of second damping wells in said upstream surface.

4. The suppressor as in claim 1, further comprising a fluid passage between said upstream surface and said frustoconical surface that provides fluid communication to said annular chamber between said frustoconical surface of said first baffle and said casing.

5. The suppressor as in claim 4, further comprising an arcuate recess in said upstream surface radially opposed to said fluid passage between said upstream surface and said frustoconical surface.

6. The suppressor as in claim 1, further comprising an alignment groove in said downstream surface of said first baffle, a second baffle located in said casing downstream from said first baffle, and said alignment groove in said downstream surface of said first baffle engages with said second baffle to orient said first baffle in a predetermined relationship with said second baffle.

7. A suppressor for a firearm, comprising:

a casing that defines a longitudinal axis;

a plurality of baffles located in said casing, wherein each baffle has an upstream surface, a downstream surface, and a frustoconical surface between said upstream and downstream surfaces, and each baffle defines a fluid pathway through said upstream, downstream, and frustoconical surfaces along said longitudinal axis;

an annular chamber between said frustoconical surface of each baffle and said casing;

a first contoured wall that extends upstream a first height from said upstream surface of each baffle, wherein said first contoured wall defines a perimeter around a first damping well in said upstream surface;

a second contoured wall that extends upstream a second height from said upstream surface of each baffle, wherein said second contoured wall defines a perimeter around a second damping well in said upstream surface; and wherein said first height of said first contoured wall of each baffle is larger than said second height of said second contoured wall.

8. The suppressor as in claim 7, further comprising in each baffle a fluid passage between said upstream surface and said frustoconical surface that provides fluid communication to said annular chamber between said frustoconical surface of each baffle and said casing.

9. The suppressor as in claim 8, further comprising in each baffle an arcuate recess in said upstream surface radially opposed to said fluid passage between said upstream surface and said frustoconical surface.

10. The suppressor as in claim 7, further comprising in each baffle an alignment groove in said downstream surface, wherein said alignment groove is configured to engage with a downstream baffle to orient adjacent baffles in a predetermined relationship.

11. A suppressor for a firearm, comprising:

a casing that defines a longitudinal axis;

a first baffle located in said casing, wherein said first baffle has an upstream surface, a downstream surface, and a frustoconical surface between said upstream and downstream surfaces, and said first baffle defines a fluid pathway through said upstream, downstream, and frustoconical surfaces along said longitudinal axis;

an annular chamber between said frustoconical surface of said first baffle and said casing;

a first contoured wall that extends upstream a first height from said upstream surface of said first baffle, wherein said first contoured wall defines a perimeter around a first damping well in said upstream surface;

a second contoured wall that extends upstream a second height from said upstream surface of said first baffle, and wherein said second contoured surface defines a perimeter around a second damping well in said upstream surface;

a fluid passage between said upstream surface and said frustoconical surface that provides fluid communication to said annular chamber between said frustoconical surface of said first baffle and said casing; and an arcuate recess in said upstream surface radially opposed to said fluid passage between said upstream surface and said frustoconical surface.

12. The suppressor as in claim 11, wherein said first height of said first contoured wall is larger than said second height of said second contoured wall.

13. The suppressor as in claim 11, further comprising an alignment groove in said downstream surface of said first baffle, a second baffle located in said casing downstream from said first baffle, and said alignment groove in said downstream surface of said first baffle engages with said second baffle to orient said first baffle in a predetermined relationship with said second baffle.

* * * * *